US009183743B2

(12) United States Patent
Vahidi et al.

(10) Patent No.: US 9,183,743 B2
(45) Date of Patent: Nov. 10, 2015

(54) SYSTEMS AND METHODS FOR ESTIMATING TRAFFIC SIGNAL INFORMATION

(71) Applicant: Bayerische Motoren Werke Aktiengesellschaft, Munich (DE)

(72) Inventors: Ardalan Vahidi, Greenville, SC (US); S. Alireza Fayazi, Clemson, SC (US); Grant Mahler, Los Altos Hills, CA (US); Andreas Winckler, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/068,791

(22) Filed: Oct. 31, 2013

(65) Prior Publication Data

US 2015/0120175 A1 Apr. 30, 2015

(51) Int. Cl.
*G08G 1/01* (2006.01)

(52) U.S. Cl.
CPC ..... *G08G 1/0141* (2013.01); *G08G 1/0112* (2013.01); *G08G 1/0133* (2013.01)

(58) Field of Classification Search
CPC .. G08G 1/0112; G08G 1/0133; G08G 1/0141
USPC ..... 701/117, 119
See application file for complete search history.

(56) References Cited

U.S. PATENT DOCUMENTS 7,519,472 B1 * 4/2009 Grigsby et al. ..... 701/468
8,855,904 B1 * 10/2014 Templeton et al. ..... 701/119
2007/0208495 A1 * 9/2007 Chapman et al. ..... 701/117
2007/0208501 A1 * 9/2007 Downs et al. ..... 701/119
2008/0071465 A1 * 3/2008 Chapman et al. ..... 701/117
2010/0250127 A1 * 9/2010 Hilbrandie et al. ..... 701/209
2013/0076538 A1 * 3/2013 Uno et al. ..... 340/905
2013/0103291 A1 * 4/2013 Hayashida et al. ..... 701/117

(Continued)

FOREIGN PATENT DOCUMENTS

CN 102779415 A * 11/2012
DE 10025039 C2 * 9/2003

(Continued)

OTHER PUBLICATIONS

Wang, Chunmei et al., "Estimation of traffic signal parameters by FCD", 19th ITS world Congress, Vienna, Austria, Oct. 22/26, 2012, 8 pages.*

(Continued)

*Primary Examiner* — Behrang Badii
*Assistant Examiner* — David Testardi
(74) *Attorney, Agent, or Firm* — Crowell & Moring LLP

(57) ABSTRACT

Systems and methods for estimating traffic signal information are provided. According to one aspect, positioning system data is obtained from a plurality of vehicles. Each data set includes the position and the velocity of a vehicle as functions of time. For an intersection having a traffic signal, an average acceleration of the vehicles when leaving the intersection is estimated, and an average deceleration of the vehicles when approaching the intersection is estimated. For each of a subset of the vehicles, a stop duration at the intersection is estimated based on the average acceleration, the average deceleration, and the positioning system data for the respective vehicle. A duration of a red phase of the traffic signal is estimated based on the stop duration of each of the subset of the vehicles.

9 Claims, 19 Drawing Sheets

(56) References Cited

U.S. PATENT DOCUMENTS

| | | | | |
|---|---|---|---|---|
| 2013/0253797 | A1* | 9/2013 | McNew | 701/98 |
| 2014/0266798 | A1* | 9/2014 | Witte et al. | 340/907 |
| 2014/0277986 | A1* | 9/2014 | Mahler et al. | 701/93 |
| 2015/0012206 | A1* | 1/2015 | Wiebel et al. | 701/119 |
| 2015/0015421 | A1* | 1/2015 | Krijger et al. | 340/932 |

FOREIGN PATENT DOCUMENTS

| | | | |
|---|---|---|---|
| JP | 2009116508 | A * | 5/2009 |
| JP | 2012221167 | A * | 11/2012 |
| JP | 2013130931 | A * | 7/2013 |

OTHER PUBLICATIONS

Zhu, Tongyu et al., "An evaluation of travel time on urban road network", 2011 11th International Conference on ITS Telecommunications, Aug. 23-25, 2011, St. Petersburg, Russia, pp. 497 to 502.*

Google translation of CN 102779415 (with English abstract; original CN document published Nov. 14, 2012).*

Jun, Jungwook et al., "Smoothing methods designed to minimize the impact of GPS random error on travel distance speed and acceleration profile estimates", Transportation Research Record: Journal of the Transportation Research Board, Issue No. 1972, 2006, pp. 141 to 150.*

Lv, Weifeng et al., "An FCD information processing model under traffic signal control", 2009 Ninth International Conference on Intelligent Systems Design and Applications, Nov. 30-Dec. 2, 2009, pp. 1161-1166.*

Wang, C. et al., "Traffic signal phases estimation by floating car data", 2012 12th International Conference on ITS Telecommunications, Nov. 5-Nov. 8, 2012, pp. 568-573.*

Zhu, Tong-yu et al., "Urban road network travel time calculation model based on signal control", Computer Engineering (in Chinese), vol. 38 No. 12, Jun. 2012, pp. 279-282, full text downloaded from link at http://www.ecice06.com/EN/abstract/abstract23507.shtml.*

Mueller, E. A., "Aspects of history of traffic signals," *IEEE Transactions on Vehicular Technology*, vol. VT19, No. 1, pp. 6-17, 1970.

Asadi, B. et al., "Predictive cruise control: Utilizing upcoming traffic signal information for improving fuel economy and reducing trip time," *IEEE Transactions on Control Systems Technology*, vol. 19, No. 3, pp. 707-714, 2011.

Koukoumidis, E. et al., "SignalGuru: Leveraging mobile phones for collaborative traffic signal schedule advisory," *Proceedings of MobiSys'11*, pp. 127-140, 2011.

Department of Transportation, "Cooperative Intersection Collision Avoidance Systems," Web, http://www.its.dot.gov/cicas/, last accessed Sep. 11, 2013.

Apple, J. et al., "Green Driver: AI in a microcosm," in *Proceedings of AAAI Conference on Artificial Intelligence*, San Francisco, CA, pp. 1311-1316, 2011.

National Transportation Operations Coalition, "National traffic signal report card," http://www.ite.org/REPORTCARD/, last accessed Sep. 11, 2013.

Work, D.B. et al., "An ensemble kalman filtering approach to highway traffic estimation using gps enabled mobile devices," in *Proceedings of 47th Conference on Decision and Control*, Cancun, Mexico, pp. 5062-5067, 2008.

Herrera, J.C. et al., "Evaluation of traffic data obtained via GPS-enabled mobile phones: The Mobile Century field experiment," *Transportation Research part C*, vol. 18, pp. 568-583, 2010.

Hofleitner, A. et al., "Learning the dynamics of arterial traffic from probe data using a dynamic bayesian network," *IEEE Transactions on Intelligent Transportation Systems*, vol. 13, pp. 1679-1693, 2012.

Ban, X. et al., "Delay pattern estimation for signalized intersections using sample travel times," *Transportation Research Record*, vol. 2130, pp. 109-119, 2009.

Kerper, M. et al., "Learning traffic light phase schedules from velocity profiles in the cloud," in *Proceedings of 5th International Conference on New Technologies, Mobility and Security* (*NTMS*), pp. 1-5, 2012.

Cabspotting, "http://cabspotting.org/", last accessed Sep. 11, 2013.

Nextbus, "http://www.nextbus.com/", last accessed Sep. 11, 2013.

Gattis, J.L. et al., "School bus acceleration characteristics," Tech. Rep. FHWA/AR-009, Mack-Blackwell Transportation Center, University of Arkansas, 1998.

Yoon, S. et al., "A methodology for developing transit bus speed-acceleration matrices to be used in load-based mobile source emission models," in *Proceedings of TRB annual meeting*, pp. 1-16, 2005.

Mahler, G. et al., "Reducing idling at red lights based on probabilistic prediction of traffic signal timings," in *Proceedings of the American Control Conference*, Montreal, Quebec, pp. 6557-6562, 2012.

Bishop, C. M., *Pattern Recognition and Machine Learning*, Springer, 2007.

Official United States Time by National Institute of Standards and Technology, "http://nist.time.gov/", last accessed Sep. 11, 2013.

Co-pending U.S. Appl. No. 13/840,830, filed Mar. 15, 2013.

* cited by examiner

SYSTEMS AND METHODS FOR ESTIMATING TRAFFIC SIGNAL INFORMATION

BACKGROUND OF THE INVENTION

The present invention relates to systems and methods for estimating traffic signal information. Traffic signals have been an indispensable element of our transportation networks since their inception and are not likely to change form or function in the foreseeable future. While traffic signals ensure safety of conflicting movements at intersections, they also cause much delay, wasted fuel, and tailpipe emissions. Frequent stops and goes induced by a series of traffic lights often frustrate drivers. In arterial driving, the complex and unknown switching pattern of traffic signals often makes accurate travel time estimation or optimal routing impossible, even with modern traffic-aware in-vehicle navigation systems.

Many of these difficulties arise due to the lack of information about the current and future states of traffic signals. In an ideal situation where the state of a signal's timing and phasing is known, the speed of a vehicle could be adjusted for a timely arrival at green. One can expect considerable fuel savings in city driving with related art predictive cruise control algorithms. When idling at red becomes unavoidable, knowledge of the remaining red time can determine if an engine shutdown is worthwhile. A collision warning system can benefit from the signal timing information and warn against potential signal violations. Future navigation systems that have access to the timing plan of traffic lights can find arterial routes with less idling delay and can also provide more accurate estimates of trip time.

The main technical challenge to deploying such in-vehicle functionalities is in the reliable estimation and prediction of Signal Phase and Timing (SPaT) information. Uncertainties arising from the clock drift of fixed-time signals, various timing plans of actuated traffic signals, and traffic queues render this a challenging and open-ended problem. Direct access to signal timing plans and the real-time state of the signal is prohibitively difficult, due to the hundreds of local and federal entities that manage the more than 300,000 traffic lights across the United States alone. Even when such access is granted, much effort and time must be spent in structuring information from various municipalities in standard and uniform formats. The recent emphasis on Dedicated Short Range Communication (DSRC) technology for communicating the state of traffic signals to nearby vehicles has safety benefits, but requires heavy infrastructure investments and is limited by its short communication range.

In recent years several related art methods have been developed that utilize mobile phone or vehicle probe data for estimation of traffic flow. Today many traffic information providers, such as Google®, INRIX®, and Waze®, use data from vehicle and cellular phone probes, as well as other devices, to estimate the severity of traffic on highways nearly in real-time. However, such algorithms perform relatively poorly in arterial networks, because traffic signals induce complex queue and stop-and-go dynamics. Other related art methods have focused on estimating queue lengths and determining locations of traffic signals and stop signs by using vehicle probe data. However, the related art does not provide a systematic attempt to derive SPaT information from available vehicle data streams. M. Kerper, C. Wewetzer, A. Sasse, and M. Mauve, "Learning traffic light phase schedules from velocity profiles in the cloud," in *Proceedings of 5th International Conference on New Technologies, Mobility and Security* (*NTMS*), 2012, pp. 1-5, describes a simulation study that is performed to show the feasibility of determining SPaT information using probe data. However, the results are limited by the assumptions that the data is updated at a high rate of approximately 1 Hz, and that the penetration level is high.

Unfortunately, currently one cannot expect high update rates from public fleets that broadcast their information, nor is there a proliferation of vehicle probes. Most related art vehicle probes provide only event-based updates, for example at a time of a crash or an air-bag deployment. Some data sources, such as San Francisco taxi cab data available through the Cabspotting program, have update rates of only once per minute. Slightly more frequent updates are available through NextBus®, a service that provides a real-time eXtensible Markup Language (XML) feed of a global positioning system (GPS) time stamp, position, velocity, and several other attributes of transit buses of a few cities in North America. Some instances of this feed, such as San Francisco MUNI stream, have update rates on the order of twice per minute. Further, intersections along a bus route are generally traversed by a bus every few minutes during the day.

Accordingly, it would be advantageous to provide systems and methods for estimating traffic signal phase and timing information from statistical patterns in low-frequency probe data. For example, it would be advantageous to estimate cycle times and durations of reds and greens for fixed-time traffic lights, and to estimate the future starts of greens in real-time. Such information about traffic signals' phase and timing may be valuable in enabling new fuel efficiency and safety functionalities in connected vehicles. For example, velocity advisory systems could use the estimated timing plan to calculate velocity trajectories that reduce idling time at red signals and therefore improve fuel efficiency and lower emissions. In addition, advanced engine management strategies could shut down the engine in anticipation of a long idling interval at red. Further, intersection collision avoidance and active safety systems could also benefit from the predictions. Various applications of SPaT information are discussed in copending U.S. application Ser. No. 13/840,830, the entire disclosure of which is incorporated by reference.

SUMMARY OF THE INVENTION

Exemplary embodiments of the invention provide systems and methods for estimating traffic signal information. According to an aspect of the invention, positioning system data is obtained from a plurality of vehicles. Each data set includes the position and the velocity of a vehicle as functions of time. For an intersection having a traffic signal, an average acceleration of the vehicles when leaving the intersection is estimated, and an average deceleration of the vehicles when approaching the intersection is estimated. For each of a subset of the vehicles, a stop duration at the intersection is estimated based on the average acceleration, the average deceleration, and the positioning system data for the respective vehicle. A duration of a red phase of the traffic signal is estimated based on the stop duration of each of the subset of the vehicles.

The average acceleration and the average deceleration may be estimated based on the positioning system data for the vehicles and a location of a stop bar behind which the vehicles stop at the intersection. The average acceleration and the average deceleration may be estimated by using a least-square estimation and removing outlier data points.

The subset of the vehicles may be determined by selecting vehicles whose positioning system data include data points within a distance interval surrounding the intersection, wherein at least a first one of the data points is before the intersection and at least a second one of the data points is after the intersection; removing vehicles whose velocity is lower than a threshold; for each of the remaining vehicles, estimating an intersection delay based on the positioning system data for the respective vehicle; and removing vehicles whose intersection delay is negative or zero.

For each of the subset of the vehicles, estimating the stop duration may include estimating a stop time at which the respective vehicle stops at the intersection based on the positioning system data for the respective vehicle and the average deceleration; estimating a start time at which the respective vehicle leaves the intersection based on the positioning system data for the respective vehicle and the average acceleration; and estimating the stop duration based on the stop time, the start time, the average deceleration, and the positioning system data for the respective vehicle. Vehicles for which the stop time is greater than the start time may be removed.

Each data set may be obtained from a cellular telephone and/or a navigation device within the vehicle. The duration of the red phase of the traffic signal may be estimated by determining a maximum stop duration of the subset of the vehicles during a time period with relatively light traffic. The update frequency of the positioning system data may be not greater than twice per minute.

According to another aspect of the invention, positioning system data is obtained from a plurality of vehicles. Each data set includes the position and the velocity of a vehicle as functions of time. For an intersection having a traffic signal, an average acceleration of the vehicles when leaving the intersection is estimated. For each of a subset of the vehicles, a start time at which the respective vehicle leaves the intersection is estimated based on the positioning system data for the respective vehicle and the average acceleration. A cycle time of the traffic signal is estimated by calculating a difference between the start times of the vehicles for each pair of consecutive vehicles in the subset, and solving an optimization problem based on the differences and the cycle time. A Gaussian mixture model may be fit to a histogram of a remainder of a division of the difference and the cycle time, and a signal offset caused by a schedule change of the traffic signal may be estimated based on clusters within the Gaussian mixture model.

According to yet another aspect of the invention, positioning system data is obtained from a plurality of vehicles. Each data set includes the position and the velocity of a vehicle as functions of time. For an intersection having a traffic signal, an average acceleration of the vehicles when leaving the intersection is estimated. A start time at which the respective vehicle leaves the intersection is estimated based on the positioning system data for the respective vehicle and the average acceleration for each of a subset of the vehicles, and a start of a future green phase of the traffic signal is estimated by calculating a moving average of the start times within a time interval defined by a cycle time of the traffic signal.

The moving average may be calculated by mapping the start times within the time interval onto a circle, such that each of the start times is represented as a vector with an angle; determining an average angle as a direction of a vector sum of the vectors; and determining the moving average by mapping the average angle to a time axis. A variance of the moving average may be calculated based on a minimum cyclic distance to the moving average for a plurality of times of day, and a schedule change of the traffic signal may be detected based on a spike in the variance of the moving average as a function of time.

According to still another aspect of the invention, positioning system data is obtained from a plurality of vehicles. Each data set includes the position and the velocity of a vehicle as functions of time. Vehicles are selected whose positioning system data include data points within a distance interval surrounding the intersection, wherein at least a first one of the data points is before the intersection and at least a second one of the data points is after the intersection. For each of the selected vehicles, an intersection delay is estimated based on the positioning system data for the respective vehicle. Vehicles whose intersection delay is non-zero are removed. For each of the remaining vehicles, a time at which the traffic signal was green is determined by interpolating between a first time of the first one of the data points and a second time of the second one of the data points. An interval during which the traffic signal was green is estimated based on the times at which the traffic signal was green.

The interval during which the traffic signal was green may be estimated by aggregating the times at which the traffic signal was green by mapping the times at which the traffic signal was green onto a reference interval. A probability that the traffic signal will be green in the future may be predicted based on the interval during which the traffic signal was green.

Other objects, advantages, and novel features of the present invention will become apparent from the following detailed description of the invention when considered in conjunction with the accompanying drawings.

DETAILED DESCRIPTION OF EXEMPLARY EMBODIMENTS

Exemplary embodiments of the present invention provide systems and methods for estimating traffic signal information. FIGS. 1-4 show various embodiments in which positioning system data from vehicles is used to estimate different types of traffic signal information, such as the duration of a red (or green) phase, the cycle time of the traffic signal, the start of a future green phase of the traffic signal, and the time interval during which the traffic signal was green. Each of the methods shown in FIGS. 1-4 begins by obtaining positioning system data from a plurality of vehicles at steps 100, 200, 300, and 400, respectively. The positioning system may be GPS, GLONASS, or any other suitable satellite-based or non-satellite-based positioning system. Each data set includes the position and velocity of the respective vehicle as functions of time. The positioning system data may be obtained from any appropriate source, such as any device within or associated with public or private vehicles.

Figure 5:
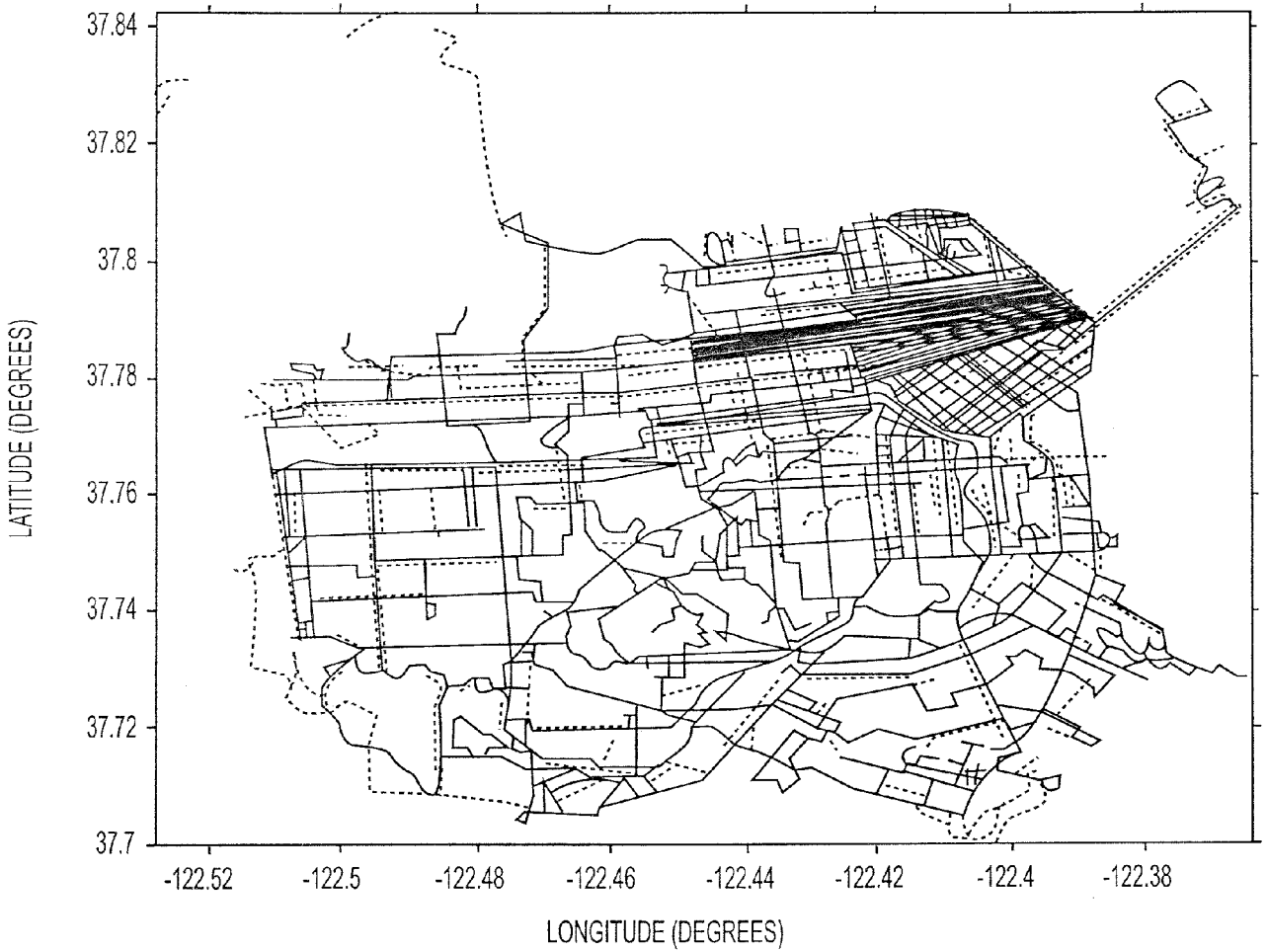
FIG. 5 shows an example of bus route updates over a period of 24 hours in the city of San Francisco.

For example, the positioning system data may be acquired from bus movements within a city. The bus data feed may be obtained from NextBus®, which provides data feeds for a number of North American cities in XML. NextBus® provides GPS data that includes the position and velocity of each bus, along with the time stamp and the bus identification number. The bus route data and the location of bus stops may be extracted from the same data stream. FIG. 5 shows a map of bus (and light rail) routes in San Francisco that is constructed by aggregating GPS updates from all buses within a twenty-four hour period.

Figure 6:
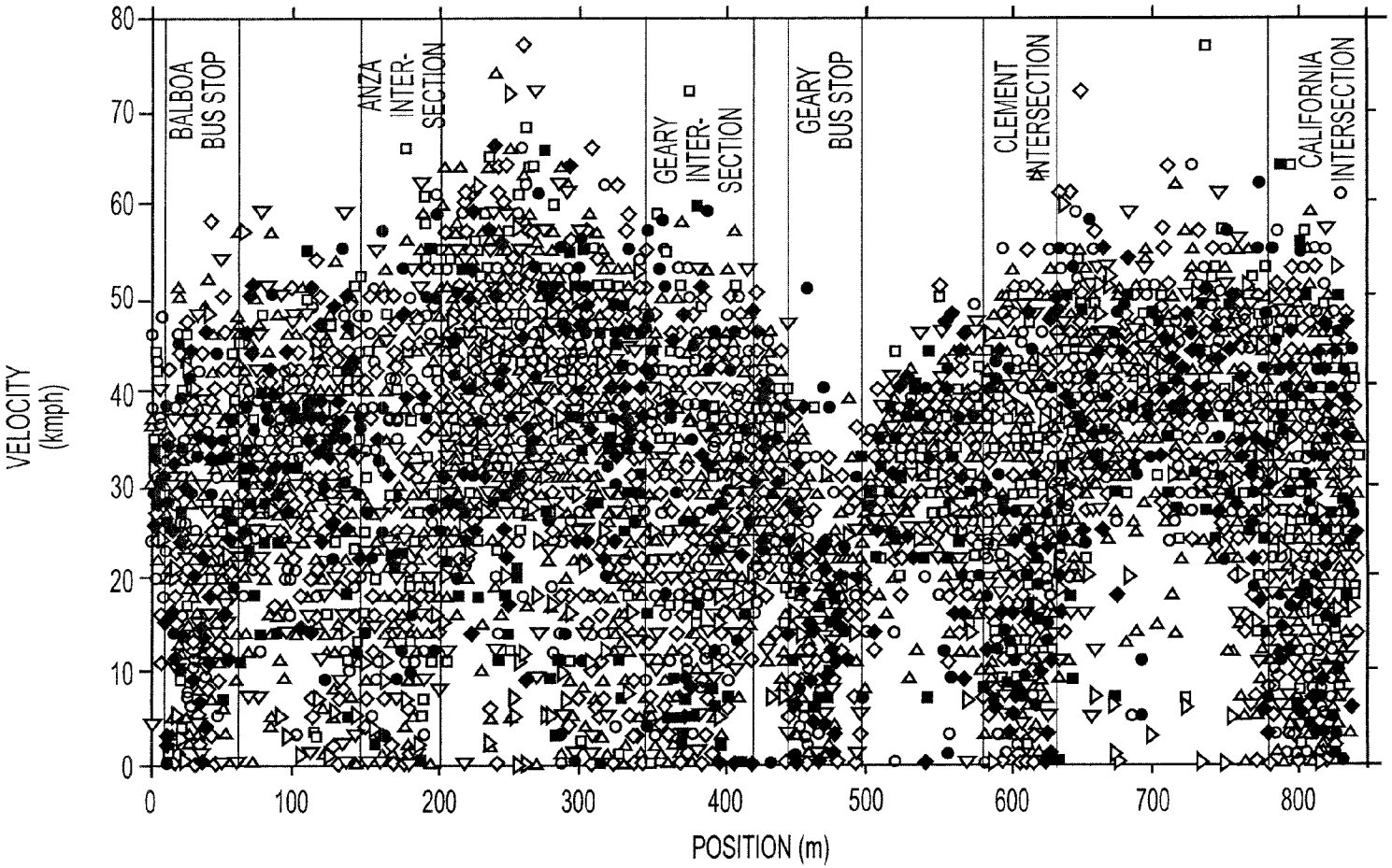
FIG. 6 shows scatter plots of bus updates for a bus route over a period of one month.

FIG. 6 shows an example of data from a portion of bus route 28 along Park Presidio Boulevard in the city of San Francisco. This is an aggregation of 2478 bus passes over an entire month. While each bus sends only four or five updates along the shown stretch of the route, the aggregated data correctly depicts the locations of intersections and bus stops.

Figure 7A:
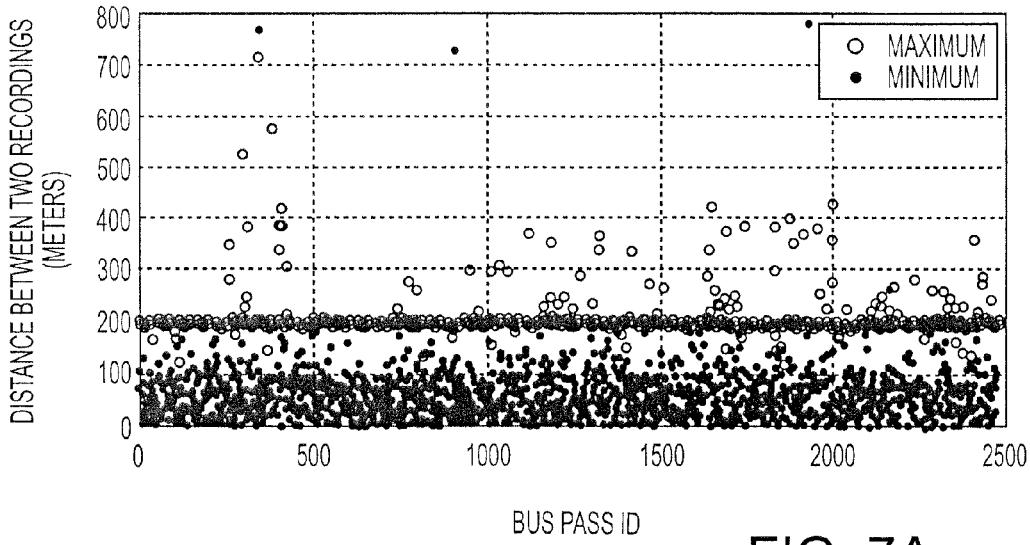
FIG. 7A shows the maximum and minimum distance between two updates of each bus pass for a bus route over a period of one month.
Figure 7B:
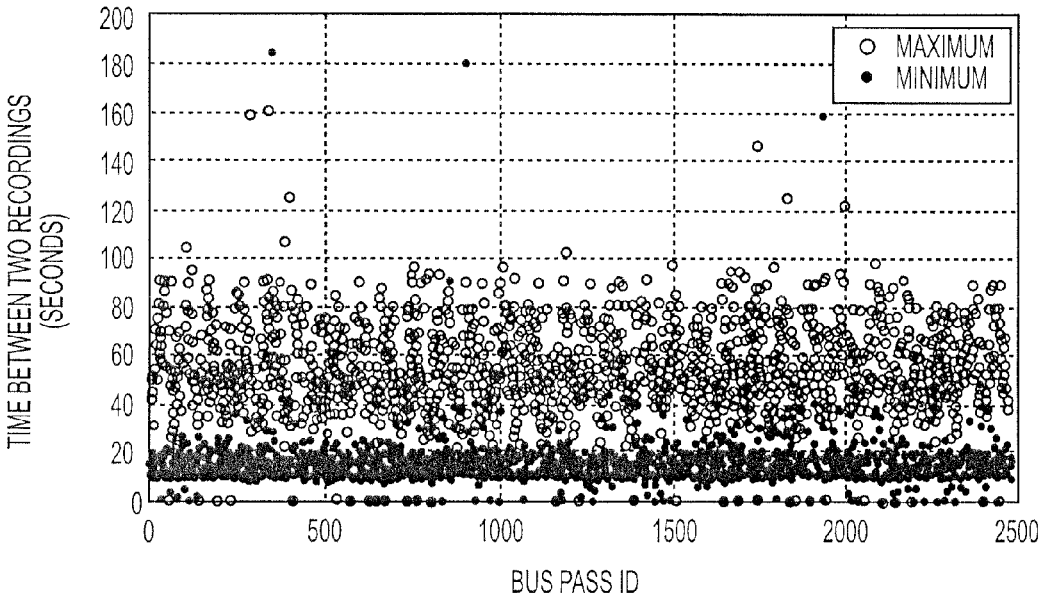
FIG. 7B shows the maximum and minimum time between two updates of each bus pass for a bus route over a period of one month.

FIG. 7A shows the maximum and minimum distance between two updates of each bus pass for every one of the 2478 bus passes. Similarly, FIG. 7B shows the maximum and minimum time between two updates of each bus pass for every one of the 2478 bus passes. According to this data, the updates do not seem to be at regular time or distance intervals. For example, time updates are anywhere between every 10 seconds up to every 80 seconds, or sometimes more. However, there is a strong concentration of data at distance intervals of 200 meters, which indicates that most updates happen every 200 meters. From these update rates it seems that slower buses update at shorter distance intervals based on a time threshold.

Exemplary embodiments of the invention determine if a bus was stopped at an intersection, estimate how long the bus was stopped at the intersection, and at what time the bus left the intersection. By aggregating this information for many buses, exemplary embodiments of the invention estimate traffic signal information, such as the duration of a red phase, the cycle length, and the start of a green phase. Because the update points for each bus are sporadic, a bus trajectory is approximated between each pair of update points.

Exemplary embodiments of the invention select bus passes that have update points within a given interval before and after that intersection. For example, for the Clement intersection shown in FIG. 6, after observing the trend in the aggregated data, bus passes that updated in both the [480 m, 590 m] and [620 m, 780 m] position intervals may be selected. In order to ensure that the influence of heavy traffic on signal timing estimation is minimized, bus passes with a low velocity, such as less than 5 km/hour, may be filtered out. This velocity may be measured when the bus is at any appropriate location, such as within one block before and after the intersection.

To determine whether a bus stopped at an intersection, the intersection delay $t_d$ may be approximated by subtracting the projected travel time from the actual travel time as follows:

$$t_d = (t_2 - t_1) - \frac{x_2 - x_1}{(v_1 + v_2)/2} \tag{1}$$

where $x_1$, $v_1$, and $t_1$ are the position, velocity, and time stamp, respectively, of the last update of a bus before an intersection of interest, and $x_2$, $v_2$, and $t_2$ are the position, velocity, and time stamp, respectively, of the first update of that bus after the intersection. Therefore $t_2-t_1$ is the actual travel time and $$\frac{x_2 - x_1}{(v_1 + v_2)/2}$$

is the estimated travel time if the velocity of the bus changed linearly between $v_1$ and $v_2$. If $t_d \leq 0$, it may be assumed that the bus had no delay, and that it passed the intersection during a green interval. Otherwise, it may be assumed that the delay was caused by a stop at a red signal, which may be further confirmed as described below.

Figure 8:
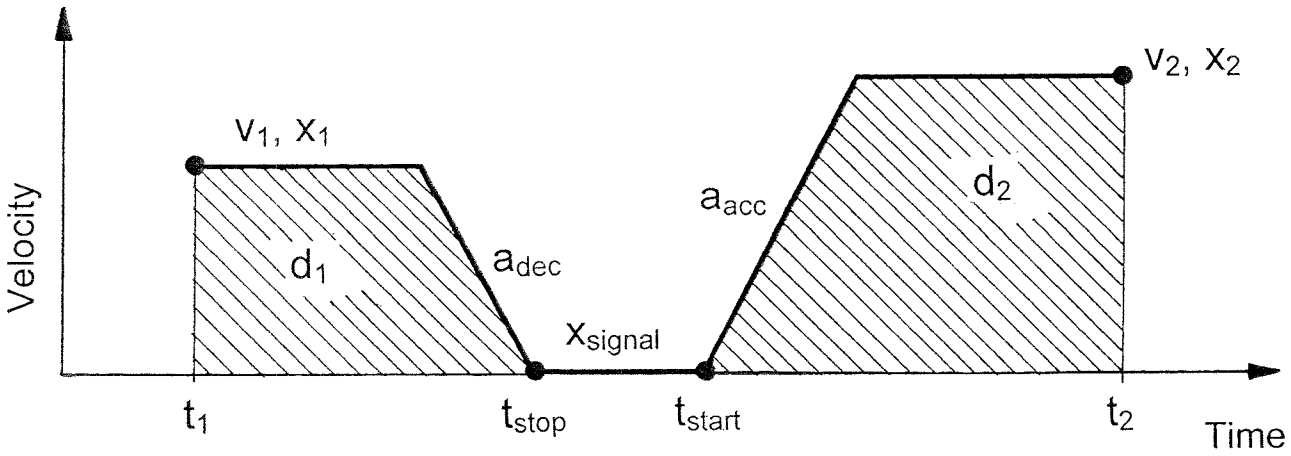
FIG. 8 shows a trajectory of a bus that stops at an intersection.

If $t_d > 0$, the consistency of the trajectory shown in FIG. 8 may be checked against the data. For example, it may be approximated that the bus moves with a constant velocity $v_1$, then comes to a stop at the intersection at a constant deceleration $a_{dec}$, and then accelerates at the start of a green with a constant acceleration $a_{acc}$ to a constant velocity $v_2$. If the location of the signal $x_{signal}$ is known, then $d_1 = x_{signal} - x_1$ and $d_2 = x_2 - x_{signal}$ are areas under the time-velocity curve. The location of the signal $x_{signal}$ may be defined as the location of a stop bar behind which vehicles stop at the intersection. Using the trapezoidal geometry of the curves, the time that a bus comes to a stop $t_{stop}$ and the time the bus leaves the intersection $t_{start}$ may be estimated as follows:

$$t_{stop} = t_1 + \frac{d_1}{v_1} + \frac{v_1}{2a_{dec}} \tag{2}$$

-continued $$t_{start} = t_2 - \frac{d_2}{v_2} - \frac{v_2}{2a_{acc}} \tag{3}$$

If $t_{stop} > t_{start}$, the postulated trajectory is invalid, and the associated bus pass may be discarded. On the other hand, if $t_{stop} \leq t_{start}$, the trajectory may be accepted as valid, and it is determined that the bus came to a full stop at a red light. The duration of red "observed" by a particular bus may then be estimated as:

$$t_{red} = t_{start} - t_{stop} + \frac{v_1}{a_{dec}} \tag{4}$$

where $$\frac{v_1}{a_{dec}}$$

is the time it takes a bus to come to a full stop after the driver detects that the signal is red. Aggregating $t_{red}$ for a sufficiently large number of bus passes may provide an estimate of total red duration of a phase.

The above calculations assume that the acceleration and deceleration of the buses are known constants. The average acceleration and deceleration of the buses may be estimated in any appropriate manner. For example, the average acceleration and deceleration may be obtained from published values in the literature. As an alternative, probe data may be used to approximate the average acceleration and deceleration of the bus fleet. As discussed below, $t_{red}$ is not highly sensitive to reasonable variations in the value of the acceleration.

Because of data sparsity, it is not possible to estimate the acceleration or deceleration of an individual bus. However, as shown in FIG. 6, velocity-position data from many buses shows a trend in the start/stop trajectory. For instance, at the Geary bus stop where a majority of buses come to a full stop, one can observe a clear slow-down and speed-up trend, which may be used to estimate an average value for a bus deceleration and acceleration, as shown later in FIG. 9. To simplify future steps, it may be assumed that deceleration to a stop and acceleration from a stop are constants, and are not functions of velocity. Hence the velocity while accelerating from a stop at a signal may be related to the distance traveled as follows:

$$v^2(x) = 2\bar{a}_{acc}(x - x_{signal}) \tag{5}$$

where $\bar{a}_{acc}$ is the average acceleration to be estimated from the data. A similar equation may be written for a deceleration interval. By defining $y = x - x_{signal}$, $\Psi = v^2(x)$, and $$\theta = \frac{1}{2\bar{a}_{acc}},$$

Equation (5) may be reorganized in the following linear parameterized form:

$$y = \theta\Psi \tag{6}$$

Figure 9A:
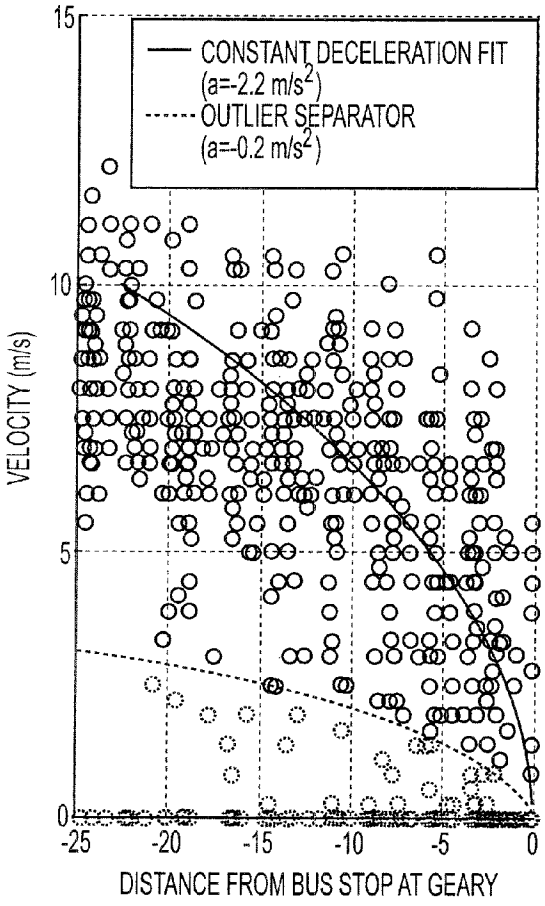
FIG. 9A shows a method of estimating the average deceleration of buses when approaching an intersection by using probe data.
Figure 9B:
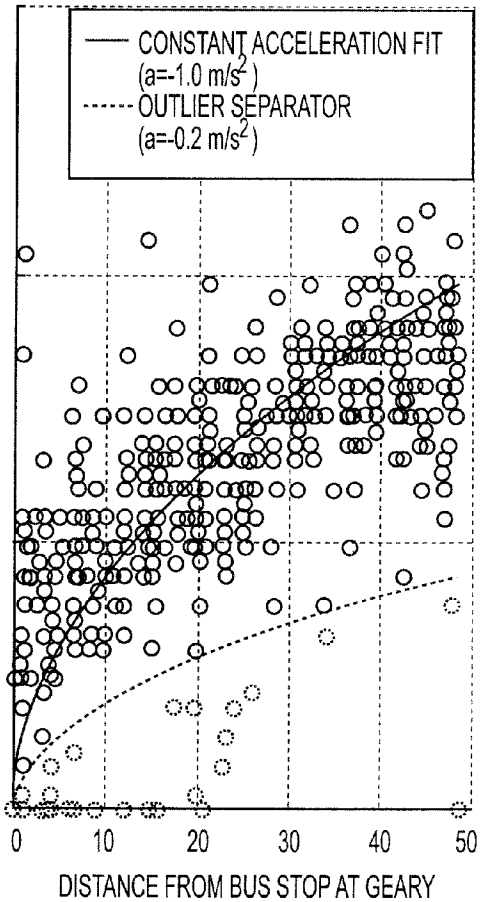
FIG. 9B shows a method of estimating the average acceleration of buses when leaving an intersection by using probe data.

Several data points may be stacked in a least-square approach to estimate the parameter θ and therefore $\bar{a}_{acc}$. As shown in FIGS. 9A and 9B, there are several outlier data points that will skew the estimation result. Accordingly, in the least square estimation, the data points below a certain acceleration/deceleration profile (shown by the dashed curves) may be ignored in order to reduce the influence of outliers. FIG. 9A shows the resulting curve fit for deceleration, and FIG. 9B shows the resulting curve fit for acceleration. The estimated deceleration is 2.2 m/s$^2$ and the estimated acceleration is 1.0 m/s$^2$. These values are consistent with bus acceleration measurements reported in J. L. Gattis, S. H. Nelson, and J. D. Tubbs, "School bus acceleration characteristics," Tech. Rep. FHWA/AR-009, Mack-Blackwell Transportation Center, University of Arkansas, 1998 and S. Yoon, H. Li, J. Jun, J. Ogle, R. Guensler, and M. Rodgers, "A methodology for developing transit bus speed-acceleration matrices to be used in load-based mobile source emission models," in *Proceedings of TRB annual meeting,* 2005.

The sensitivity of the $t_{red}$ estimate in Equation (4) to variations in acceleration (and similarly deceleration) may be calculated as $$\delta t_{red} = -\frac{v_2}{2} + \frac{\delta a_{acc}}{a_{acc}^2}.$$

Because $v_2$ is at most around 20 m/s for a city bus and $a_{acc}$ and $a_{dec}$ are greater than 1 m/s$^2$, even a 20% error in approximation of $a_{acc}$ ($\delta a_{acc}/a_{acc} = \pm 0.2$) results in a maximum error of 2 seconds for $t_{red}$. The error is much smaller in most instances where $v_2$ is much less than 20 m/s.

Exemplary embodiments of the invention may obtain the baseline timing for traffic lights by offline aggregation and averaging of crowd-sourced bus data. In particular, the duration of reds/greens of a phase and the cycle time of a traffic signal may be determined. Mere knowledge of the baseline schedule, obtained offline and using only historical data, has statistical value even when a signal's clock-time is unknown. For example, as discussed in G. Mahler and A. Vahidi, "Reducing idling at red lights based on probabilistic prediction of traffic signal timings," in *Proceedings of the American Control Conference*, Montreal, Quebec, 2012, pp. 6557-6562, the baseline schedule of a signal may be used to predict the chance of a future green for an eco-driving application.

The following examples are based on results for a segment of Van Ness street, between the Lombard and Washington intersections. This is a sometimes congested street and is therefore suited to test exemplary embodiments of the invention under (relatively heavy) city traffic conditions. Additionally, the actual signal timing cards of the intersections of Van Ness may be used to verify the validity of the estimates. Most intersections on this segment of Van Ness are fixed time intersections with the same cycle time and red duration throughout all days of the week. For most of these traffic signals, only offset times change during rush hour schedule, as described below. In these examples, one month of data (September 2012) is aggregated from two bus routes, route 47 and route 49, in the southbound direction, totaling 4289 bus passes. This data is used to estimate signals' cycle time and the timing of the phases controlling southbound traffic on Van Ness, as explained below.

Figure 1:
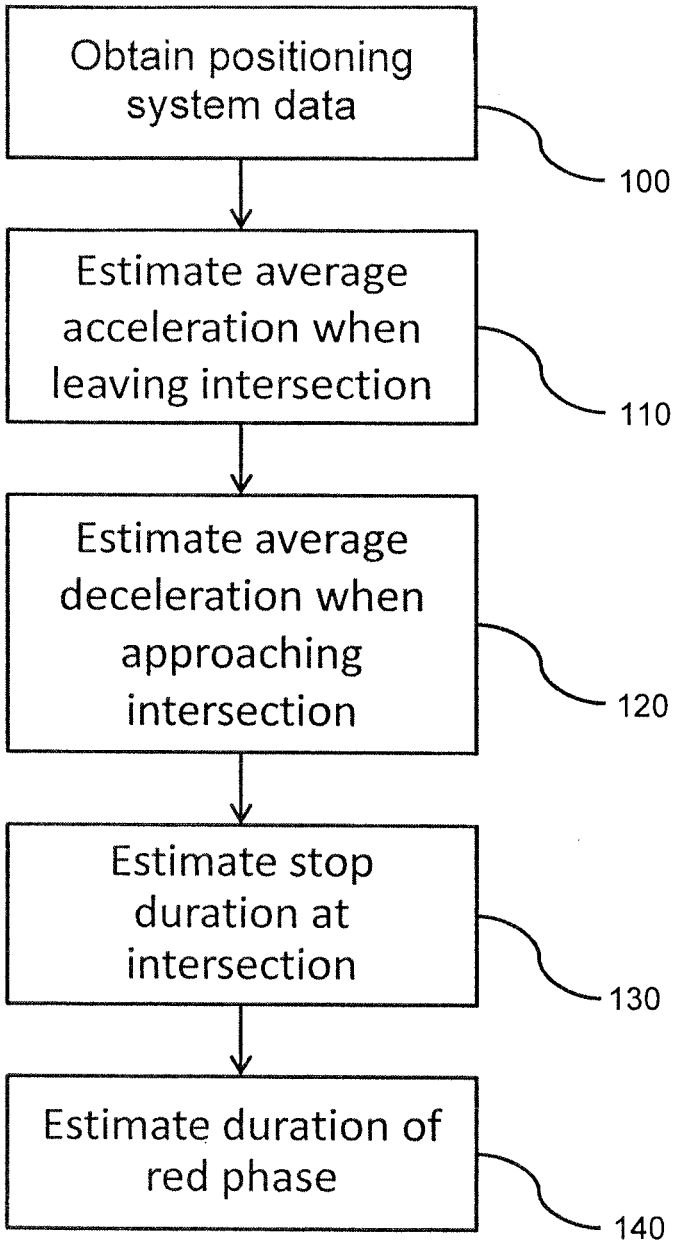
FIG. 1 shows a method for estimating the duration of a red phase of a traffic signal according to an exemplary embodiment of the invention.

As shown in FIG. 1, in order to estimate the duration of a red phase, the positioning system data is obtained at step 100, the average acceleration of the vehicles when leaving the intersection is estimated as described above at step 110, and the average deceleration of the vehicles when approaching the intersection is estimated as described above at step 120. For buses that stopped at a red light, the observed stop duration is calculated via Equation (4) at step 130. Aggregating this data provides an estimate of the duration of the red phase at step 140.

Figure 10A:
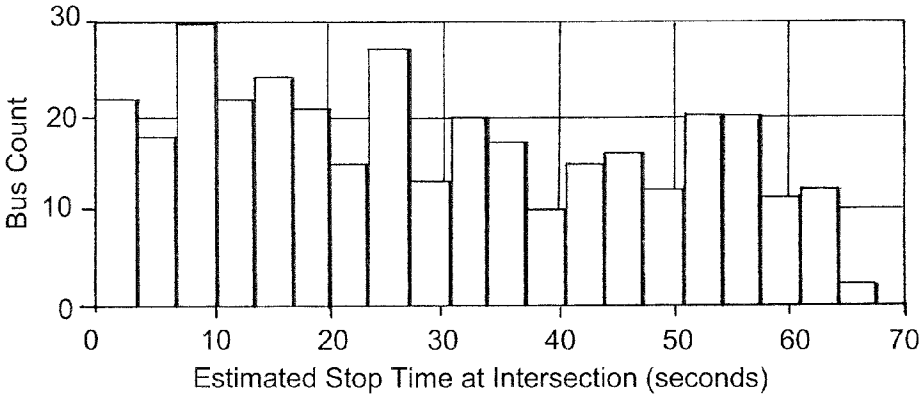
FIG. 10A shows a histogram of the estimated stop time at an intersection.
Figure 10B:
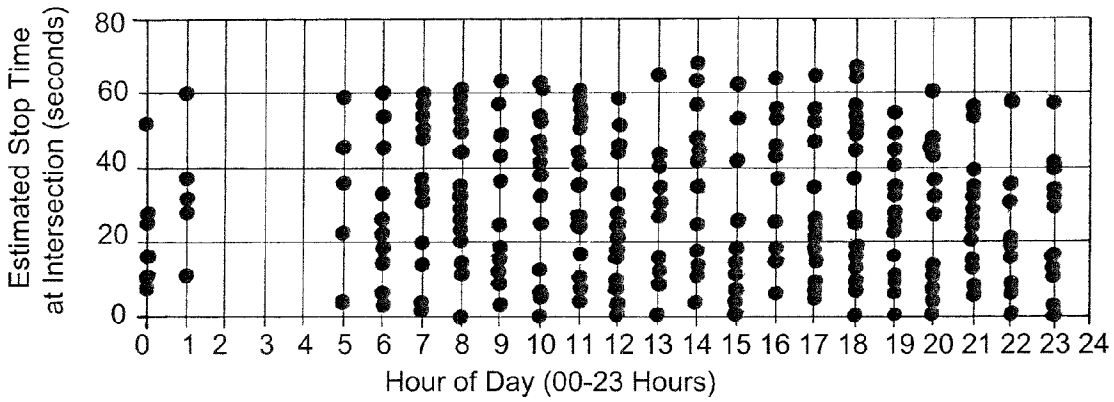
FIG. 10B shows the estimated stop time at an intersection as a function of the time of day.

For example, for the southbound phase on Van Ness street at the Lombard intersection, 347 bus passes remained after applying the filters described above to the 4289 total passes. FIG. 10A shows a histogram of the observed reds for the 347 passes. The histogram has a maximum of 68 seconds, which is an upper bound estimate to the duration of the red phase. FIG. 10B shows the observed reds at different hours of a day for an entire month. During early morning hours (midnight-6 am) and late night hours (7 pm-11 pm) when the queue lengths are expected to be shorter, the maximum observed red is 60 seconds. This corresponds well to the actual timing of this intersection. According to the city timing cards, this intersection has a 90 second cycle time that is split into 60 seconds of red, 3.5 seconds of yellow, and 26.5 seconds of green for the southbound phase. Accordingly, the duration of the red phase may be estimated as the maximum observed during a time period with relatively light traffic, such as non-rush hour times after 7 pm.

Also, many bus drivers may treat a yellow as red, thereby increasing their observed red time to a maximum of 63.5 seconds. Exemplary embodiments of the invention may account for this by subtracting 3.5 seconds from the observed red time. The process described above was repeated for a few other intersections on Van Ness, and the results are summarized in Table I. In most cases the estimated red durations are very close to the actual red durations. This is while, unlike the Lombard intersection, many of these intersections had a short red interval and a green-wave design that allowed most buses to pass through their green period; thus offering a smaller number of usable data points.

TABLE I

RED AND CYCLE TIME ESTIMATES FOR A FEW SOUTHBOUND PHASES THROUGH VAN NESS STREET, CALCULATED USING DATA FROM BUS ROUTES 47 AND 49 GATHERED FOR SEPTEMBER 2012.

| Intersection | Actual Red (seconds) | Estimated Red (seconds) | Actual Cycle (seconds) | Estimated Cycle (seconds) |
|---|---|---|---|---|
| Lombard | 60 | 60 | 90 | 90 |
| Filbert | 31.5 | 30 | 90 | 90 |
| Green | 31.5 | 35 | 90 | 90 |
| Broadway | 31 | 42 | 90 | 90 |
| Washington | 31.5 | 32 | 90 | 45 |

Figure 2:
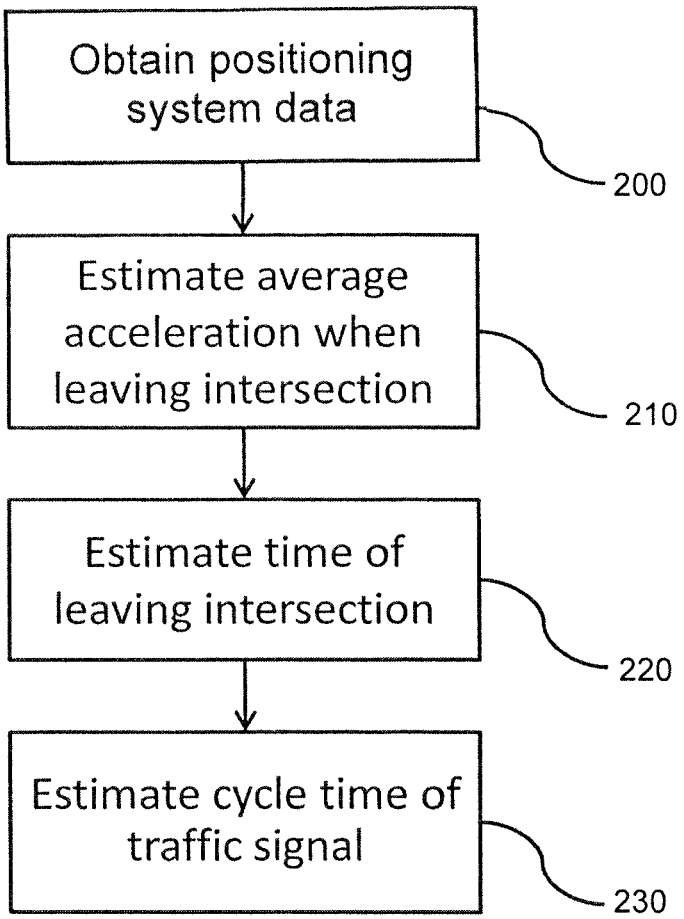
FIG. 2 shows a method for estimating the cycle time of a traffic signal according to an exemplary embodiment of the invention.
Figure 11:
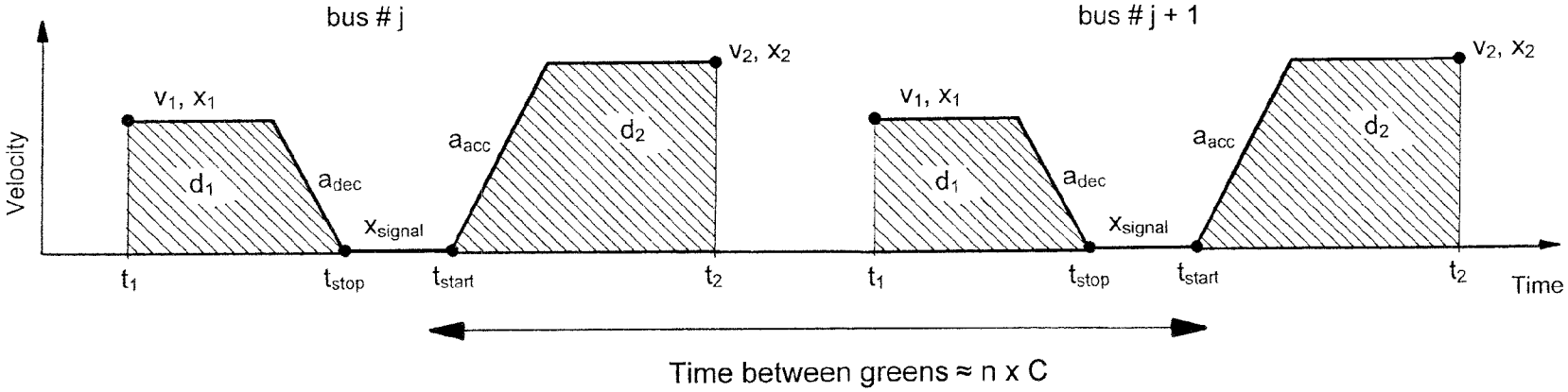
FIG. 11 shows that the time between consecutive starts of greens is an integer multiple of the cycle time for a fixed-cycle traffic signal.

As shown in FIG. 2, in order to estimate the cycle time of a traffic signal, the positioning system data is obtained at step 200, and the average acceleration of the vehicles when leaving the intersection is estimated at step 210. For fixed-time signals with phases that repeat cyclically, the time between the starts of greens of a phase must be an integer multiple of the cycle time (although due to a signal's clock drift, this may not be true for starts of greens that are far apart). Accordingly, an approximation for a start time of green may be obtained using Equation (3), i.e. the clock time that a bus starts accelerating from a stop at red. This approximation may be used as an estimate of the time at which a vehicle leaves the intersection at step 220. The difference between two consecutive approximations of starts of greens, based on bus movements, is an "almost" integer multiple of the cycle time, as shown schematically in FIG. 11. In order to estimate the cycle time of the traffic signal at step 230, the time between approximated starts of greens $b_g$ may be calculated as follows:

$$b_g(j)=t_{start}(j+1)-t_{start}(j) \tag{7}$$

For a given cycle time C, the remainder of division of $b_g$ and C may then be calculated as follows:

$$\mathrm{mod}_C(b_g)=b_g-\mathrm{round}(b_g/C)C \tag{8}$$

where the function round(•) rounds its argument to the nearest integer and the function $\mathrm{mod}_C(\bullet)$ is a modified definition of remainder of division by C that allows negative values. For example $\mathrm{mod}_{10}(12)=2$ and $\mathrm{mod}_{10}(8)=-2$.

It is expected that $\mathrm{mod}_C(b_g)$ will be close to zero on average, if the cycle time is fixed at C and signal clock drift between two qualifying bus passes is small. Therefore C may be approximated by solving the following optimization problem:

$$\overline{C} = \underset{C}{\mathrm{argmin}} \sum_{j=1}^{n} \left(\frac{mod_C(b_g(j))}{C/2}\right)^2 \tag{9}$$

where it is assumed that there are n+1 qualifying bus passes during the interval of interest and therefore n calculations of $b_g$. Observing that $$-\frac{C}{2} < mod_C(.) \leq \frac{C}{2},$$

the remainders may be normalized by C/2 to ensure that all values of C generate equivalent costs.

Figure 12A:
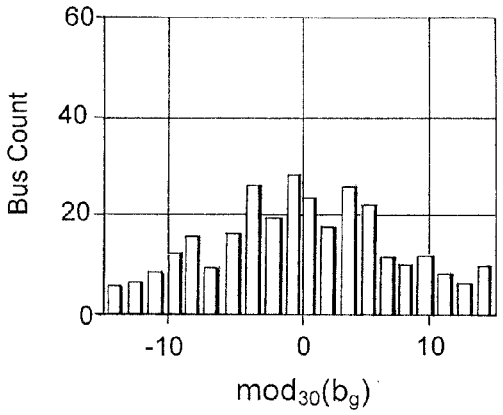
FIGS. 12A-12D show a method of estimating the cycle time for a traffic signal.
Figure 12B:
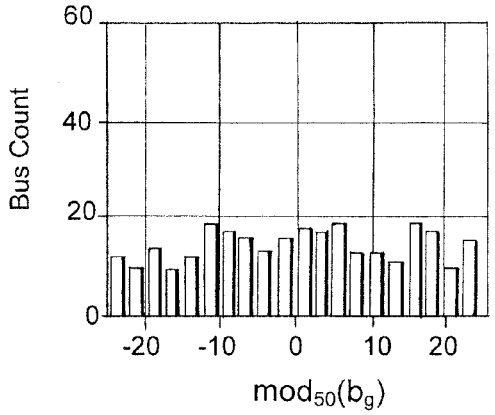
Figure 12C:
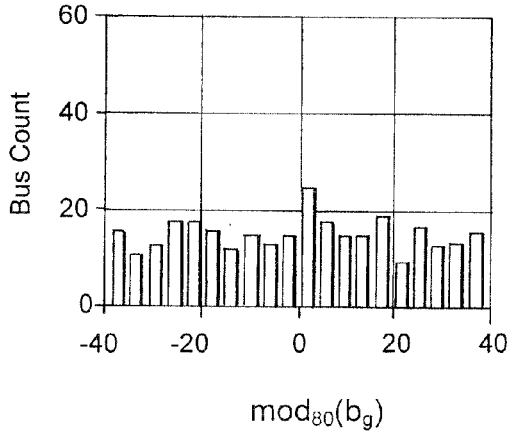
Figure 12D:
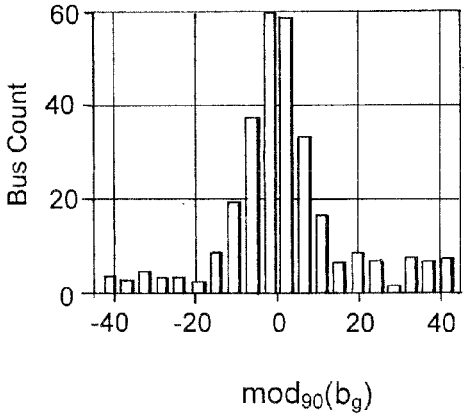

Because a signal cycle time is normally an integer and has a limited range, one can conveniently solve the above optimization problem by trying every feasible C. In the present example, integer values between 1 and 120 seconds were tried when determining cycle time of signals on Van Ness. To reduce the influence of signal clock drift, the choice of $b_g$ may be limited to those within a few hours, such as 5 hours in this example. Using one month of data, the estimated cycle time for the Lombard intersection was 90 seconds in this example, perfectly matching its actual value. This is visually illustrated in FIGS. 12A-12D, with histograms of $\mathrm{mod}_C(b_g)$ for the Lombard intersection for four different values of C. FIG. 12A shows the histogram for C=30 seconds, FIG. 12B shows the histogram for C=50 seconds, FIG. 12C shows the histogram for C=80 seconds, and FIG. 12D shows the histogram for C=90 seconds. As shown in FIG. 12D, for C=90 seconds, the histogram peaks strongly around zero despite various sources of uncertainty, i.e. unknown queue lengths and traffic conditions and approximations made in reconstructing bus trajectories. As illustrated by the clear peak in FIG. 12D, the minimization of the standard deviation when the cycle time was 90 seconds indicates that the cycle time was 90 seconds in this example. FIG. 12D also shows small bumps near the tail ends; as explained below, these bumps are direct results of changes in signal offset times during rush hour schedules.

Table I summarizes cycle estimates for a number of other intersections along Van Ness. For most intersections, the estimated and actual cycle times are identical. For the Washington intersection, the cycle time was estimated at exactly half of its actual value. This is partly due to a lack of enough qualifying bus passes for this intersection. There were only 94 bus passes that qualified the filters for the Washington intersection as compared to 347 passes for the Lombard intersection.

For real-time in-vehicle applications, it is important to have an estimate of the starts of future green (or red) phases.

Estimating the start of a green is a challenging problem: even for fixed-time signals that have fixed cycles, a periodic projection of starts of greens can be inaccurate due to signal clock drift throughout a day. To address this problem, exemplary embodiments of the invention continuously estimate the start of a green phase based on the movement of buses that accelerate from a stop at an intersection.

Figure 3:
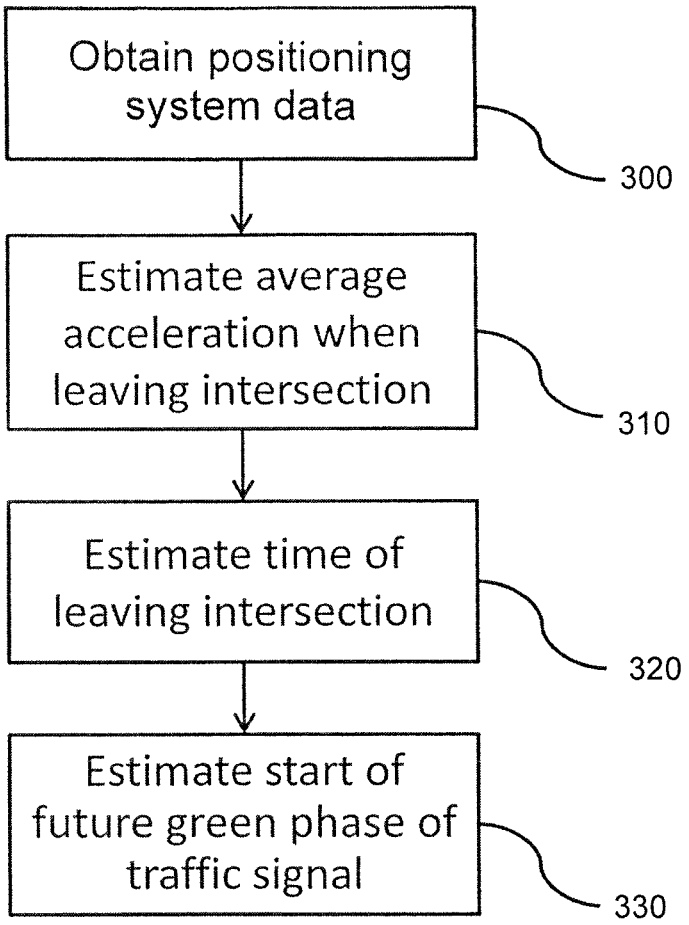
FIG. 3 shows a method for estimating the start of a future green phase of a traffic signal according to an exemplary embodiment of the invention.

As shown in FIG. 3, in order to estimate the start of a future green phase of a traffic signal, the positioning system data is obtained at step 300, and the average acceleration of the vehicles when leaving the intersection is estimated at step 310. Equation (3) may be used to estimate the time $t_{start}$ that each bus left the intersection at step 320. A moving average of the most recent times may then be used to estimate the start of a green at step 330. More specifically, because of C-periodicity of a fixed-time signal within each schedule, the latest estimates of the starts of greens may be mapped to a single reference interval $$\left[-\frac{C}{2}, \frac{C}{2}\right]$$

by applying the $\text{mod}_e$ operator, e.g. for the $i^{th}$ qualifying bus pass, as follows:

$$t_i = \text{mod}_C(t_{start}(i)) \tag{10}$$

Figure 13A:
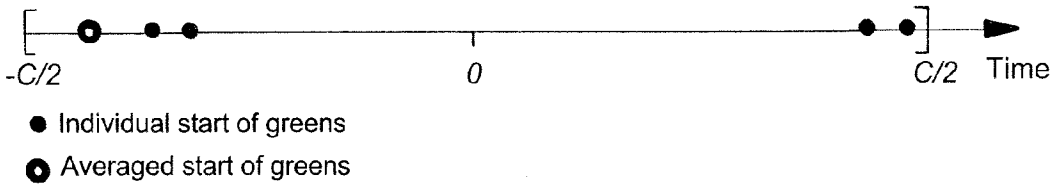
FIG. 13A shows the starts of greens mapped to a linear interval.
Figure 13B:
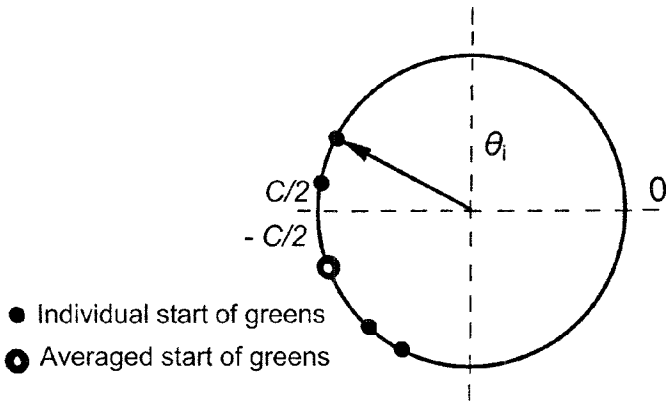
FIG. 13B shows the starts of greens mapped to a circle.
Figure 14A:
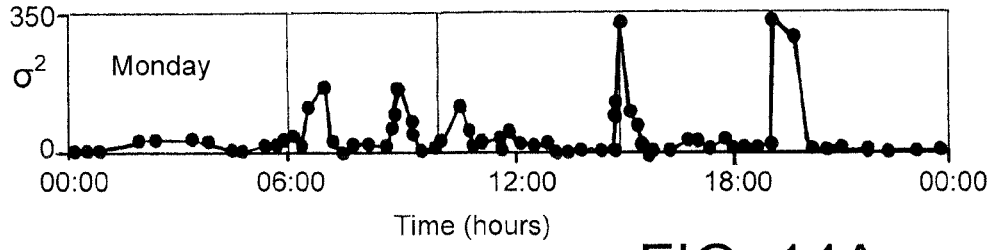
FIGS. 14A-14G show the variance of the moving average estimate of the starts of greens at an intersection for different times and days of the week.
Figure 14B:
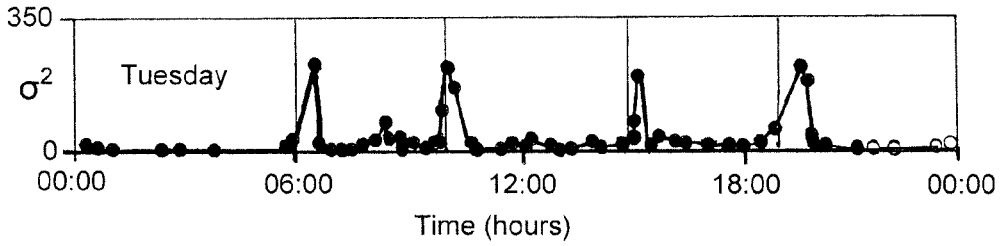
Figure 14C:
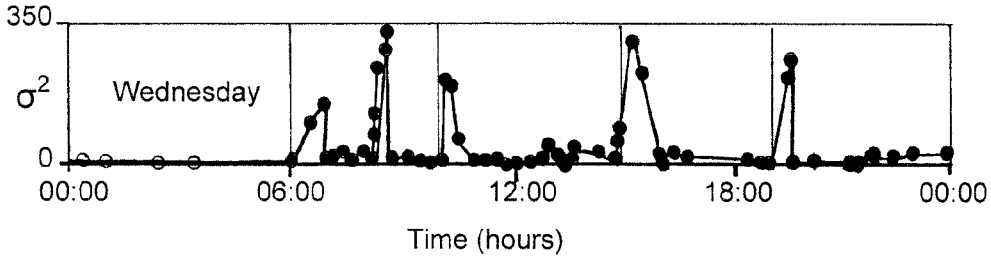
Figure 14D:
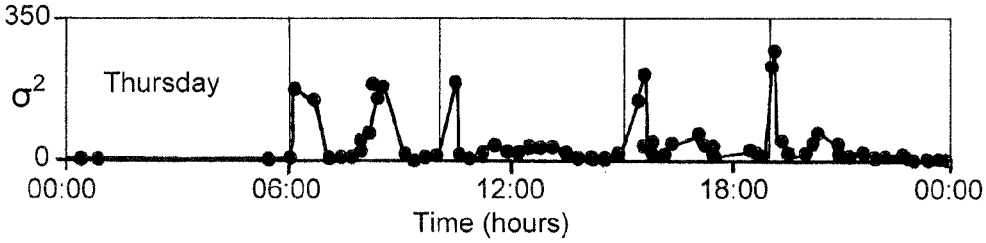
Figure 14E:
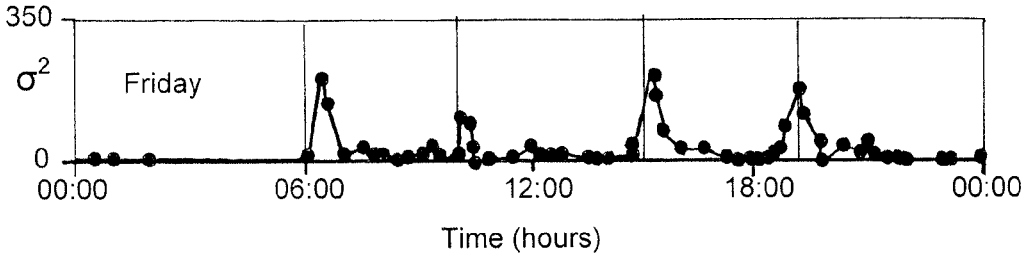
Figure 14F:
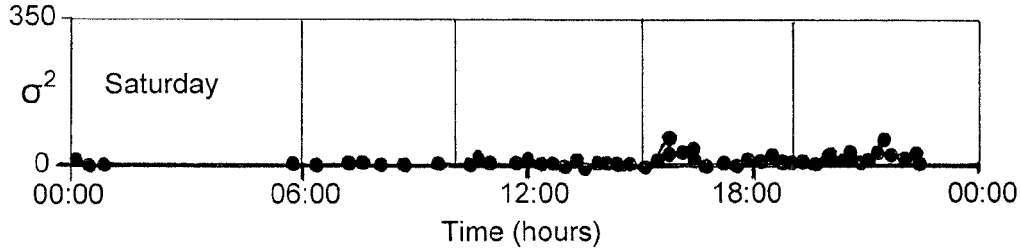
Figure 14G:
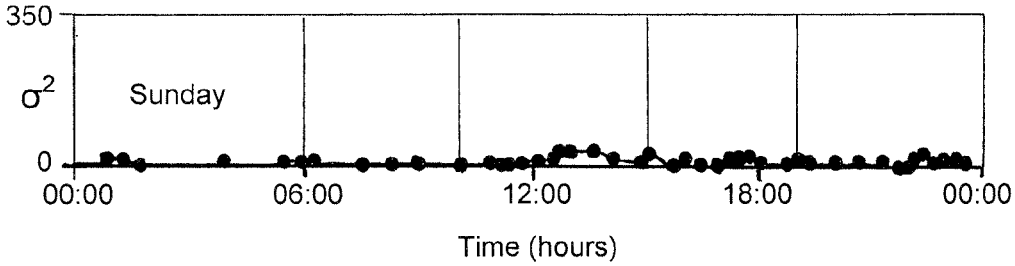

An average estimate of the start of green may then be created in this reference interval. Note that a simple "linear" average will, in general, produce an erroneous estimate due to the cycle periodicity. For example, in the schematic shown in FIG. 13A, four estimates of green mapped to the linear interval (filled circles) and their true average (unfilled circle) are shown on a straight line. As seen in this example, the true average does not fall between the individual green estimates. The periodicity can be better visualized if the time axis is wrapped onto a circle, as shown in FIG. 13B. Each start of green can then be represented by a vector with an angle $$\theta_i = \frac{2\pi}{C} t_i$$

on the circle. The average angle $\overline{\theta}_{SoG}$ is determined by the direction of the vector sum of all of the individual vectors:

$$\overline{\theta}_{SoG} = \tan^{-1} \frac{\sum_{i=1}^{m} \sin(\theta_i)}{\sum_{i=1}^{m} \cos(\theta_i)} \tag{11}$$

Here m represents the number of samples used to calculate the moving average. The average start of the green is obtained by mapping back the average angle to the time axis:

$$\overline{t}_{SoG} = \frac{C}{2\pi} \overline{\theta}_{SoG} \pm kC \; k \in Z \tag{12}$$

The variance of this estimate is then obtained based on the minimum cyclic distance to the average, equivalently calculated by:

$$\sigma^2_{SoG} = \frac{1}{m} \sum_{i=1}^{m} (mod_C(t_i - \overline{t}_{SoG}))^2 \tag{13}$$

As discussed below, in some instances, the accuracy of $\overline{t}_{SoG}$ may be enhanced by selectively choosing samples that produce smaller variances. In other words, with n latest samples, $\overline{t}_{SoG}$ and $\sigma_{SoG}$ may be calculated for all possible combinations of m<n samples, and the one with the minimum variance may be selected.

The traffic signals in the example on Van Ness street have 3 different schedules. While cycle times remain constant across multiple schedules for these intersections, each signal's offset with respect to other signals and with respect to a reference clock switches as the schedule changes. For example, at the Lombard intersection and during weekdays, the start of the cycle is moved backward by 34 seconds at 6 AM and at 3 PM, and moved forward at 10 AM and 7 PM. Exemplary embodiments of the invention may estimate the change in offset and time of this change, in order to rely on crowd-sourced data for predicting the start of a green.

A change in signal offset/schedule may be detected by keeping track of the starts of greens and detecting when a start of a green shifts significantly from its periodic prediction. A smaller value of variance calculated in Eq. (13) indicates that the corresponding m estimates of starts of greens are consistent with each other and are a multiple of C seconds apart. Right after a schedule change when the starts of greens are shifted by the offset times, the variance is expected to temporarily increase, until it is corrected by newer estimates of starts of greens. Jumps in the value of variance can then be indications of a change in the signal schedule/offset times.

In one example, three months of data are combined, and the variance of the moving average is calculated as a function of time of day. FIGS. 14A-14G show the results for the Lombard intersection for every day of the week. Clear jumps in the value of the variance appear at 6 and 10 am, and at 3 and 7 pm on a weekday. These correspond to the times that the signal schedule changes. If it is known that the signal schedule changes on the hour, a spike above a threshold value may be detected, and the time of the spike may be rounded to the nearest hour. For some days of the week there is also a large spike at around 8 AM; these spikes do not correspond to a schedule change, but perhaps are results of heavier traffic at that time. In some embodiments a spike must be present on all weekdays in order to indicate a schedule change. The plots for weekends do not have major spikes, which is consistent with the single schedule that is in effect on weekends.

Figure 15:
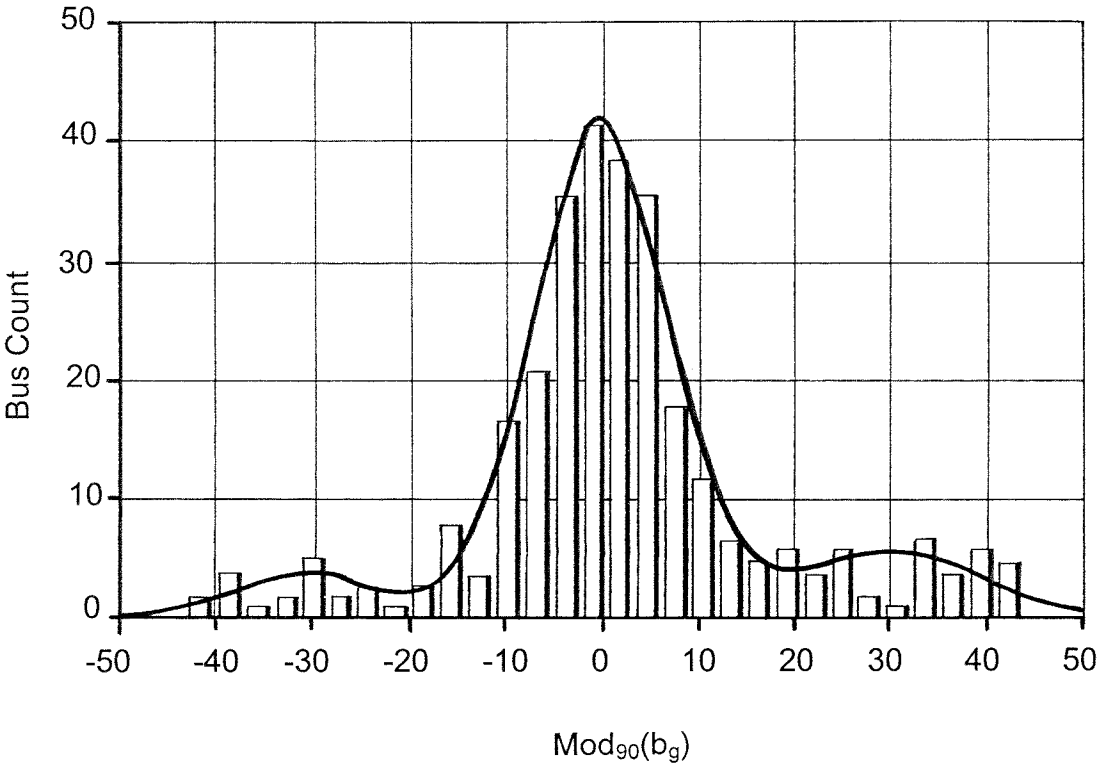
FIG. 15 shows a Gaussian mixture model that is fit to the data shown in FIG. 12D by using an Expectation Maximization algorithm.

As discussed above, FIG. 12D has small bumps near the tail ends. Using the method of Expectation Maximization (EM), a Gaussian mixture model may be fitted to the histogram in FIG. 12D. The result is plotted in FIG. 15. In this example, EM found three distinct Gaussian clusters with the parameters shown in Table II. The major cluster is centered almost at zero, which was expected; and the two minor clusters are centered at almost ±30. These correspond closely to the 34 second shift in timing of the signal during a schedule change. This was confirmed by identifying times of days at which $\text{mod}_{90}(b_g)$ exceeds ±30 seconds. In nearly all cases, this happens across multiple schedules, confirming that the tail bumps are due to signal offset. In this case, the mean of this minor clusters may be used as an estimate to the amount of schedule offset.

TABLE II

| PARAMETERS OF THE GAUSSIAN MIXTURE FIT TO HISTOGRAM OF FIG. 12 | | |
|---|---|---|
| mean (μ) | standard deviation (σ) | weight (π) |
| −30.78 | 7.32 | 0.07 |
| −0.24 | 7.02 | 0.79 |
| 29.79 | 9.32 | 0.14 |

The exemplary embodiments described above have been based on movements of buses that stopped at an intersection. These embodiments filtered out bus passes that had no intersection delay, e.g. those that cruised through a green. This approach discards a substantial amount of data, in particular for signals that either are often green or are timed in a green wave. But there is useful information that can be extracted from passes during a green. For example, it is possible to interpolate a point in time that a phase was green based on the bus data before and after an intersection.

Figure 4:
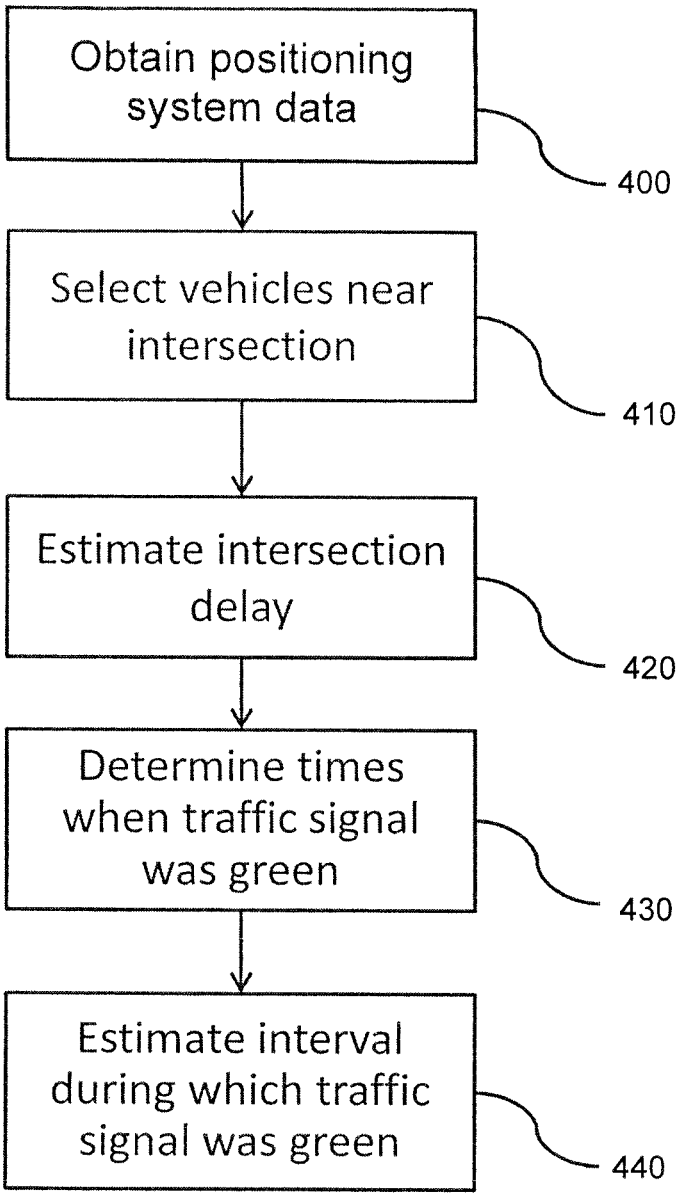
FIG. 4 shows a method for estimating the interval during which a traffic signal was green according to an exemplary embodiment of the invention.

As shown in FIG. 4, in order to estimate an interval during which a traffic signal was green, the positioning system data is obtained at step 400. Referring to FIG. 8 and given the two update tuples $[t_1, x_1, v_1]$ and $[t_2, x_2, v_2]$ across one intersection, vehicles whose positioning system data include data points within a distance interval surrounding the intersection are selected at step 410. At least one of the data points is before the intersection and at least one of the data points is after the intersection. The intersection delay is then estimated via Equation (1) at step 420. Vehicles for which the intersection delay is non-zero may be removed. A zero value (or a near zero value) for $t_d$ indicates (with high likelihood) that the bus passed through a green, and therefore its acceleration between two update points is assumed to remain approximately constant.

Next an interpolation between update times $t_1$ and $t_2$ may be used to determine the point in time at which the signal was green at step 430. For the constant acceleration case, the position of the traffic signal is given by:

$$x_{signal} = x_1 + v_1(t_g - t_1) + \frac{1}{2}a(t_g - t_1)^2 \tag{14}$$

where $$a = \frac{v_2 - v_1}{t_2 - t_1}$$

is the constant acceleration between two update points. Here $t_g$ denotes a time at which the signal was green, which is the feasible solution to the above quadratic equation:

$$t_g = t_1 + \frac{-v_1 + \sqrt{v_1^2 + 2a(x_{signal} - x_1)}}{a} \tag{15}$$

Figure 16A:
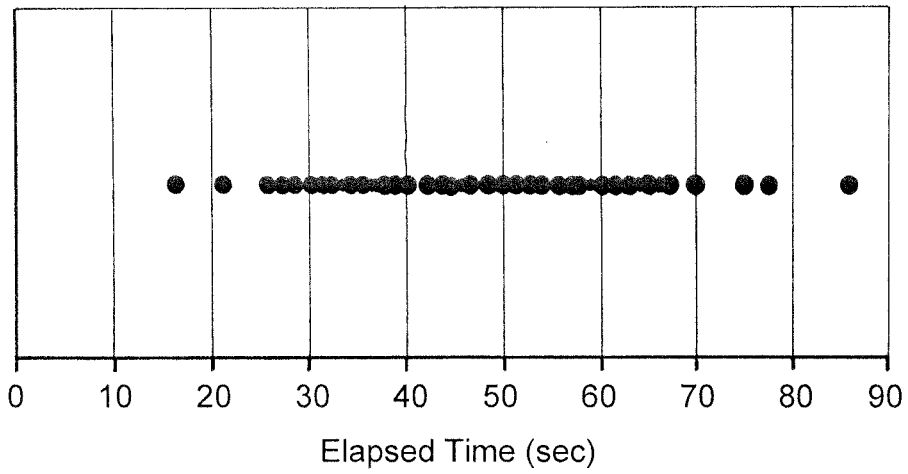
FIG. 16A shows green times that are mapped to a single interval.
Figure 16B:
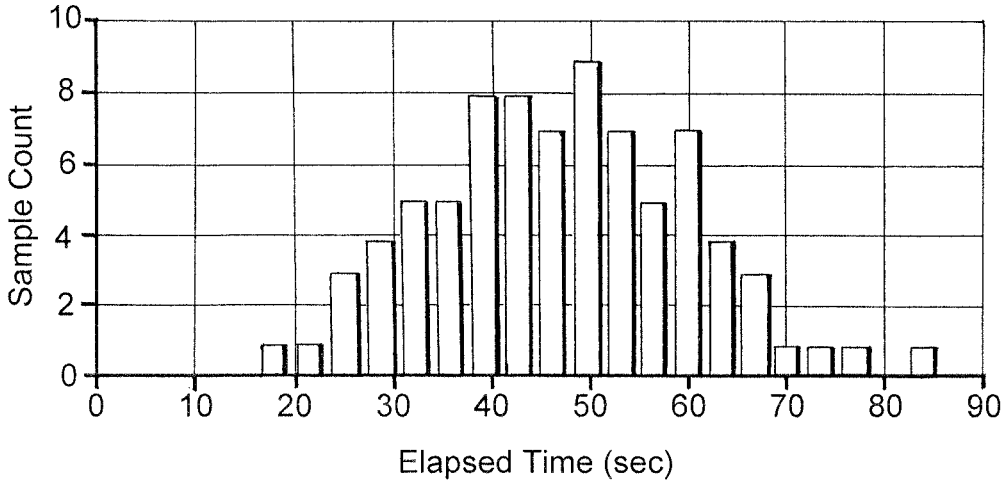
FIG. 16B shows a histogram indicating the concentration of data points of green times.
Figure 17A:
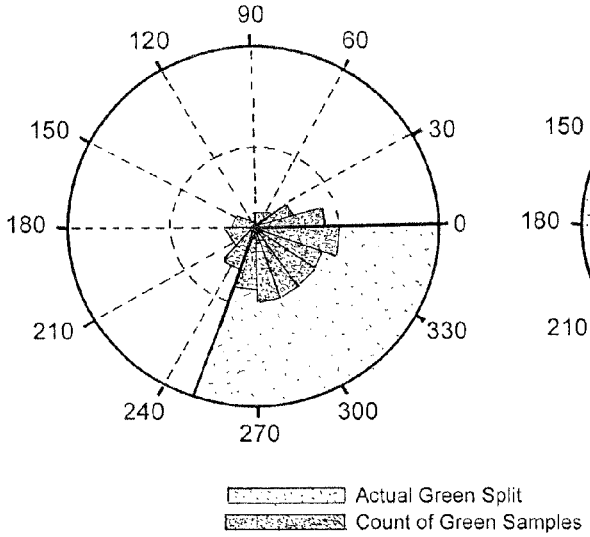
FIGS. 17A-17D show crowd-sourced and actual green times mapped to one circular cycle in polar histograms for different intersections.
Figure 17B:
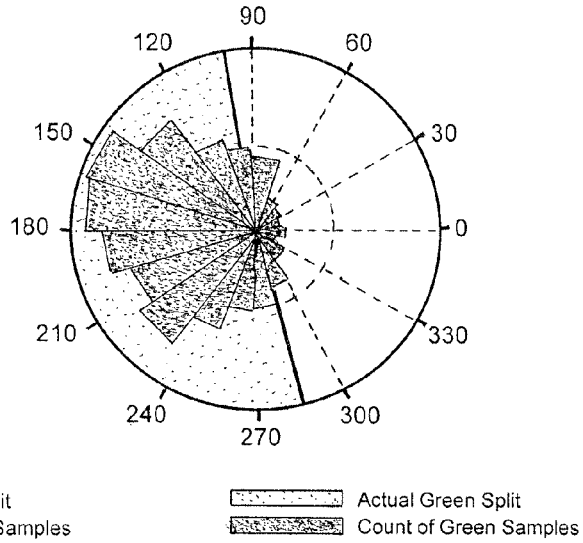
Figure 17C:
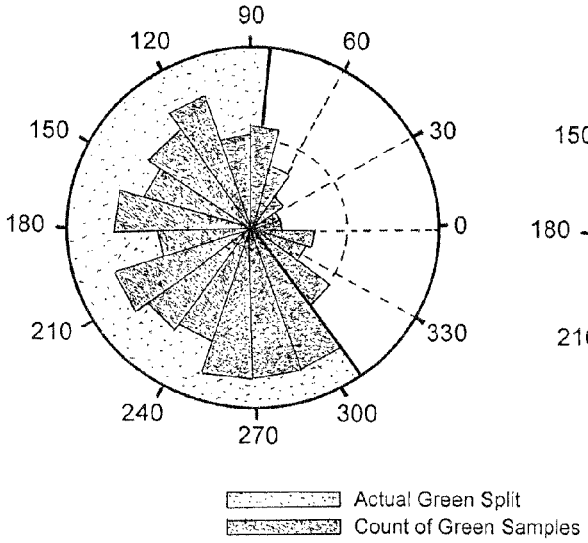
Figure 17D:
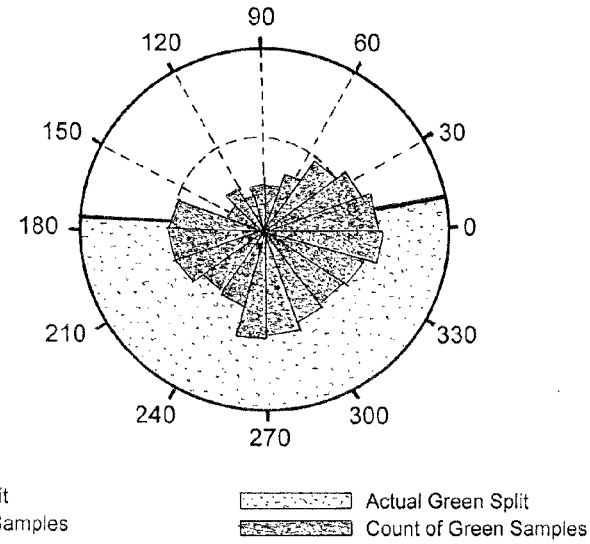

Exemplary embodiments of the invention aggregate all point calculations of $t_g$ to estimate intervals of green at step 440. For signals with a fixed and known cycle time C, this can be done by mapping all values of $t_g$ onto a reference interval [0,C]. FIG. 16A shows the results for the Lombard intersection. When mapping all green times to a single interval, known changes in the signal schedule are accounted for. FIG. 16B shows a histogram highlighting the concentration of data points. In the ideal situation when a signal had no clock drift and repeated the same state at the exact same time every day, this mapping would result in an interval of green exactly matching the signal's green time; i.e., 26.5 seconds for the Lombard intersection. But because the signal clock drifts, and also due to errors in reconstructing bus kinematics, the plotted green interval has a wider range than the actual green time. However there is much stronger concentration of mapped greens in the middle, as shown by the histogram of FIG. 16B. This time period, and periods cyclically mapped forward, are where the probability of green is the highest. Even in the absence of any further crowd-sourced data, this probabilistic information is useful for many in-vehicle applications.

Because of the cyclic periodicity, the data can be better visualized if mapped onto a polar histogram in which one revolution corresponds to one cycle time. FIGS. 17A-17D show such polar histogram plots for the Lombard, Union, Broadway, and Washington intersections along Van Ness, respectively. The height of each triangle represents the number of green samples within that triangle interval. Also shown by shaded areas on these plots are the actual green intervals, as observed and recorded in ground truth observations. It can be seen that the actual and crowd-sourced estimates of green interval match relatively well. The differences can be attributed to signal clock drift and to errors in generating the crowd-sourced estimates.

The probability that the traffic signal will be green in the future may be predicted based on the interval during which the traffic signal was green. The probability may be determined by normalizing the histograms shown in FIG. 16 and/or FIG. 17.

To determine the accuracy of the estimates, in particular the starts of greens, on-site ground truth tests were performed at the intersection of Lombard and Van Ness streets on Jun. 6, 2013. Between the hours of 7 AM and 4 PM, the actual start of a green of the southbound phase on Van Ness was recorded almost every 15 minutes as the ground truth. This was done with the aid of a computer program that upon a key press would log the time as synchronized with the NIST time server. The human observer's reaction time was determined to be less than 0.3 seconds.

Concurrently, the starts of greens were estimated according to the exemplary embodiments described above. This was done in real-time via a crowd-sourcing backend server. The XML updates from routes of interest are continuously parsed and the data is written to a SQL data server. Another computational node constantly monitors the data to estimate starts of greens and records the results on the SQL server. As an alternative, the agreement between actual starts of greens and crowd-sourced starts-of-greens could be monitored in real-time via a PHP web interface.

After each qualifying bus pass, new estimates for starts of greens were generated using i) the last data point only, ii) minimum-variance average of 3 samples chosen out of last 6 data points, and iii) minimum-variance average of 2 samples chosen out of last 4 data points. Note that crowd-sourced estimates of greens are sparse in time due to the fact that the bus data that qualifies the filters described above is infrequent. Therefore, between two actual estimates, the starts of greens are cyclically mapped using the estimated cycle time of the traffic signal. Also the change in signal offset during schedule change is accounted for in this process. The estimated values for starts of greens are then compared to the actual ground readings of the starts of greens.

Figure 18:
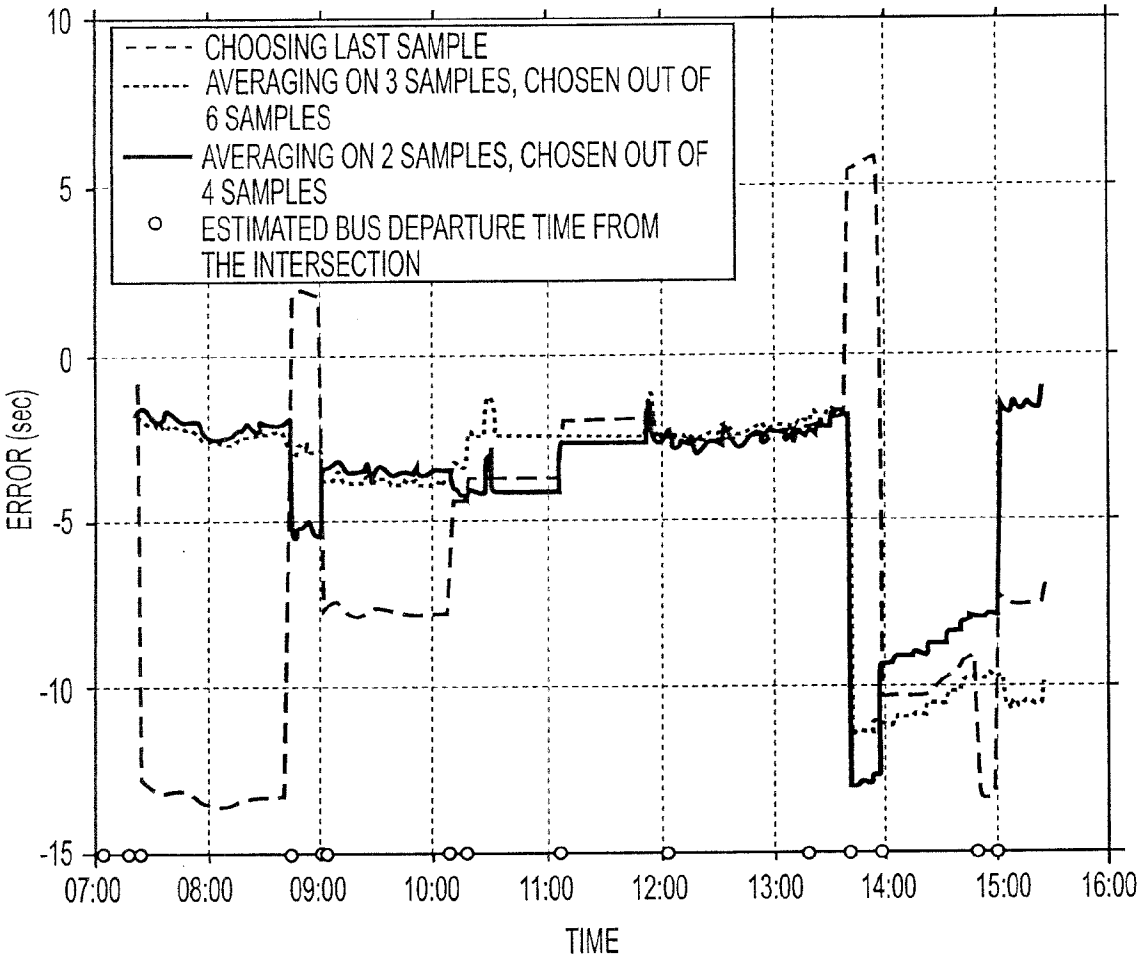
FIG. 18 shows the error between the crowd-sourced and the actual starts of greens.

FIG. 18 demonstrates the error between the crowd-sourced and actual starts of greens. The jumps in error plots in FIG. 18 correspond to the times when a new qualifying bus pass occurs. The drift in between is due to the actual drift of the signal clock and is not a by-product of crowd-sourcing. The root-mean-square and maximum error of each estimation approach are summarized in Table III. It can be observed that the minimum variance estimates are reasonably close to the actual timing with an RMS error of around 5 seconds. The estimate that was based on only the last sample was more prone to error in this case.

TABLE III

ROOT-MEAN-SQUARE AND MAXIMUM ESTIMATION ERROR FOR STARTS-OF-GREENS

| Estimation Method | RMS Error (Sec.) | Max. Error (Sec.) |
|---|---|---|
| Last data point | 7.7 | 13.6 |
| 3 out of 6 data points | 5.4 | 11.4 |
| 2 out of 4 data points | 4.7 | 13.0 |

The methods discussed above are executed by a computer processor that is programmed to perform the methods so that the processor executes the programming to perform the methods. Such a processor is needed to handle the large volumes of data and to perform the complex and computationally-intensive analysis of the methods discussed above. In addition, the processor is required to perform the methods in a commercially viable timeframe. Accordingly, it is necessary to quickly process large and complex data sets.

According to another exemplary embodiment of the invention, there is provided a non-transitory computer-readable medium encoded with a computer program for estimating traffic signal information. The term "computer-readable medium" as used herein refers to any medium that participates in providing instructions for execution. Common forms of computer-readable media include, for example, a floppy disk, a flexible disk, a hard disk, magnetic tape, any other magnetic medium, a CD-ROM, any other optical medium, punch cards, paper tape, any other physical medium with patterns of holes, a RAM, a PROM, an EPROM, a FLASH-EPROM, any other memory chip or cartridge, and any other non-transitory medium from which a computer can read.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of estimating traffic signal information and adjusting an operation of an on-board system of a vehicle, the method comprising:

obtaining positioning system data from each of a plurality of vehicles, wherein said positioning system data for each of the plurality of vehicles comprises position and velocity of a vehicle as functions of time;

for an intersection having a traffic signal, estimating an average acceleration of the vehicles when leaving the intersection and an average deceleration of the vehicles when approaching the intersection;

for each of a subset of the vehicles, estimating a stop duration at the intersection based on an estimated stop time, an estimated start time, the average acceleration, the average deceleration, and the positioning system data for the respective vehicle;

removing vehicles from the subset for which the estimated stop time is greater than the estimated start time;

estimating a duration of a red phase of the traffic signal based on the stop duration of each of the subset of the vehicles; and adjusting the operation of the on-board system of the vehicle based, at least in part, on the estimated red phase of the traffic signal.

2. The method according to claim 1, wherein the average acceleration and the average deceleration are estimated based on the positioning system data for the vehicles and a location of a stop bar behind which the vehicles stop at the intersection.

3. The method according to claim 2, wherein estimating the average acceleration and the average deceleration comprises using a least-square estimation based on data points of velocity versus traveled distance corresponding to the vehicles and by removing outliers of said data points.

4. The method according to claim 1, wherein for each of the subset of the vehicles, estimating the stop duration comprises:

estimating the estimated stop time at which the respective vehicle stops at the intersection based on the positioning system data for the respective vehicle and the average deceleration;

estimating the estimated start time at which the respective vehicle leaves the intersection based on the positioning system data for the respective vehicle and the average acceleration; and estimating the stop duration based on the estimated stop time, the estimated start time, the average deceleration, and the positioning system data for the respective vehicle.

5. The method according to claim 1, wherein the positioning system data for each of the plurality of vehicles is obtained from at least one of a cellular telephone or a navigation device within the vehicle.

6. The method according to claim 1, wherein the duration of the red phase of the traffic signal is estimated by determining a maximum stop duration of the subset of the vehicles during a time period with relatively light traffic.

7. The method according to claim 1, wherein an update frequency of the positioning system data is not greater than twice per minute.

8. A method of estimating traffic signal information and adjusting an operation of an on-board system of a vehicle, the method comprising:

obtaining positioning system data from each of a plurality of vehicles, wherein said positioning system data for each of the plurality of vehicles comprises position and velocity of a vehicle as functions of time;

for an intersection having a traffic signal, estimating an average acceleration of the vehicles when leaving the intersection and an average deceleration of the vehicles when approaching the intersection;

for each of a subset of the vehicles, estimating a stop duration at the intersection based on the average acceleration, the average deceleration, and the positioning system data for the respective vehicle;

estimating a duration of a red phase of the traffic signal based on the stop duration of each of the subset of the vehicles; and adjusting the operation of the on-board system of the vehicle based, at least in part, on the estimated red phase of the traffic signal, wherein the subset of the vehicles is determined by:

selecting vehicles whose positioning system data include data points within a distance interval surrounding the intersection, wherein at least a first one of the data points is before the intersection and at least a second one of the data points is after the intersection;

removing vehicles whose velocity is lower, at a point either before the intersection or after the intersection, than a threshold;

for each of the remaining vehicles, estimating an intersection delay based on the positioning system data for the respective vehicle; and removing vehicles whose estimated intersection delay is negative or zero.

9. The method according to claim 8, further comprising removing vehicles for which an estimated stop time is greater than an estimated start time.

* * * * *